United States Patent [19]

Knapp

[11] Patent Number: 5,014,048

[45] Date of Patent: May 7, 1991

[54] MATRIX DISPLAY SYSTEMS

[75] Inventor: Alan G. Knapp, Crawley, England

[73] Assignee: U.S. Philips Corporation, New York, N.Y.

[21] Appl. No.: 262,565

[22] Filed: Oct. 24, 1988

[30] Foreign Application Priority Data

Dec. 7, 1987 [GB] United Kingdom ..... 8728538

[51] Int. Cl.[5] ..... G09G 3/36

[52] U.S. Cl. ..... 340/784; 340/805; 350/333

[58] Field of Search ..... 340/784, 805, 719, 802, 340/765; 350/333, 334

[56] References Cited

U.S. PATENT DOCUMENTS

| | | | |
|---|---|---|---|
| 4,233,603 | 11/1980 | Castleberry | 340/784 |
| 4,709,992 | 12/1987 | Ueno | 350/333 |
| 4,715,685 | 12/1987 | Yaniv et al. | 350/334 |
| 4,731,610 | 3/1988 | Baron et al. | 340/784 |
| 4,748,445 | 5/1988 | Togashi et al. | 340/719 |
| 4,892,384 | 1/1990 | Kuijk | 340/784 |

*Primary Examiner*—Alvin E. Oberley
*Assistant Examiner*—M. Fatahiyar
*Attorney, Agent, or Firm*—Michael E. Marion

[57] ABSTRACT

An active matrix addressed liquid crystal display system suitable for TV purposes, driven by applying to one of the conductors associated with each display element drive signals comprising a selection signal portion for setting a display condition followed by a sustain signal portion for sustaining that condition for an interval prior to receipt of the next selection signal, the magnitude of the sustain signal is decreased over its duration, thereby avoiding vertical cross-talk problems or the need to increase the number of diode structures. The sustain signal is decreased gradually, either continuously or in steps, so as to minimise the mean voltage across the non-linear element, and preferably in accordance with the decay time constant of the liquid crystal material of the display element.

23 Claims, 6 Drawing Sheets

Fig. 10(a)
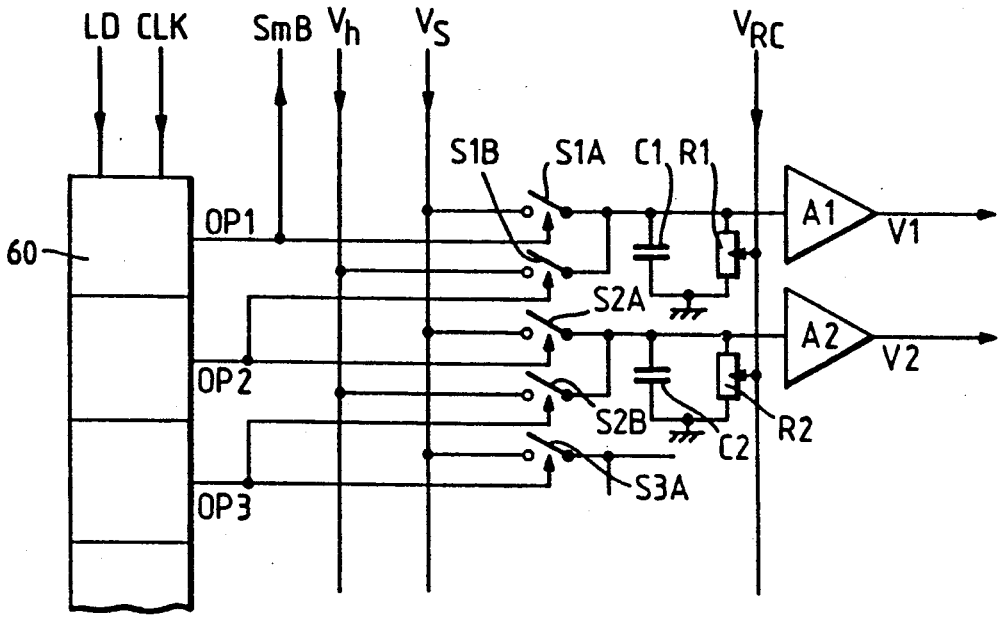
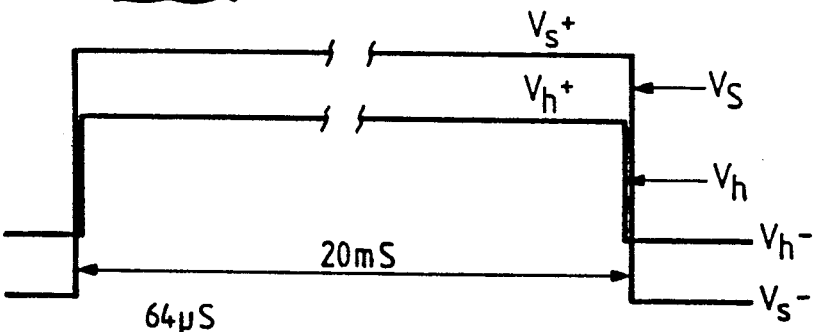
FIG. 10(b)
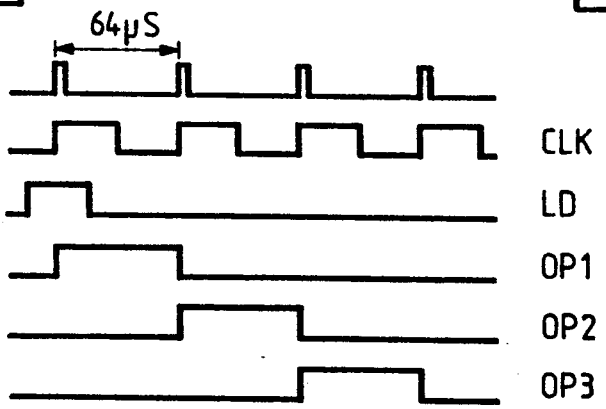
FIG. 10(c)
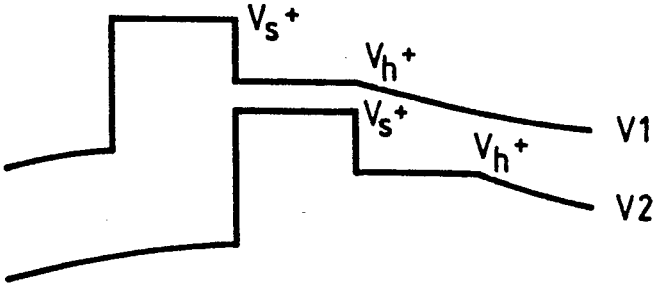
FIG. 10(d)

MATRIX DISPLAY SYSTEMS

BACKGROUND OF THE INVENTION

The present invention relates to a matrix display system comprising a plurality of row and column conductors, a plurality of picture elements each comprising a liquid crystal display element connected in series with an associated two terminal non-linear resistance element exhibiting a threshold characteristic between a row conductor and a column conductor, and drive signal generating means for applying drive signals to the row and column conductors for driving the display elements, the drive signal supplied to one of the two conductors associated with each picture element consisting of a selection signal portion during which the display element is set to a desired display condition and a sustain signal portion for sustaining that display condition during a subsequent interval prior to the picture element receiving a further selection signal portion.

An active matrix display system of this kind is suitable for displaying alpha-numeric or video, e.g. TV, information.

Display systems of this kind in which the non-linear resistance elements comprise diode structures are known.

In FIGS. 1(*a*) and 1(*b*) of the accompanying drawings, there are shown diagrammatically two examples of the basic circuit configuration of a typical picture element and its associated row and column conductors of a known form of such a liquid crystal display system. In these circuits, each liquid crystal display element 12, constituted by a pair of spaced electrodes with liquid crystal material therebetween, is connected in series with a diode ring type of non-linear resistance element 14, comprising in these examples a pair of diodes connected in parallel with opposing polarities, between a row, scanning, conductor 16 and a column, data, conductor 18. The two forms of circuit configurations shown are electrically equivalent and perform in the same manner. The choice between them is made purely on technological grounds.

The transmission (T)-RMS voltage (Vlc) curve of the liquid crystal material, the current (I) voltage ($V_R$) characteristic of the diode ring and the drive waveforms applied to the row and column conductors are illustrated in FIGS. 2, 3 and 4(*a*) and 4(*b*), respectively.

The purpose of the diode ring is to act as a switch in series with the display element. When a given row of the display is to be driven, the voltage applied to the row conductor concerned, illustrated by the waveform of FIG. 4*a*, is taken to one of two selected levels Vs. In common with most other liquid crystal display systems the polarity of the voltage applied across the liquid crystal display element is inverted every field. Since the operation of the picture elements in the positive and negative cycles are exactly equivalent, the following discussion will consider a cycle of only one polarity for simplicity.

During the "select" period $t_g$ (FIG. 4*a*), corresponding in the case of TV display to a maximum of a line period, the voltage across the diode ring and display element causes the diode ring to operate in the charging part of the diode ring characteristic, indicated at C in FIG. 3. In this region the diode ring current is large and the display element capacitance rapidly charges to a voltage, Vp, given by the expression:

$$Vp = Vcol - Vs - Vd, \quad (1)$$

where Vcol and Vs are respectively the voltage applied to the column conductor 18 at that time and the select voltage applied to the row conductor 16, and Vd is the voltage drop across the diode ring. Vcol is derived, in the case of a TV display, by sampling the appropriate line of the incoming video signal, in accordance with known practice. At the end of the select period $t_s$ the row voltage falls to a new, lower, and constant value Vh (FIG. 4*a*) which is selected so that the mean voltage across the diode ring during the next approximately 20 milliseconds, corresponding to the usual field period for TV display less the duration of the period $t_s$, when the row is next addressed again with a select voltage, is minimised. In theory, assuming an ideal situation, this sustain, or hold, voltage Vh is equal to the mean of the rms saturation and threshold voltages (as shown in FIG. 2), that is:

$$Vh = (Vsat + Vth)/2. \quad (2)$$

Under these conditions the maximum voltage of either polarity appearing across the diode ring is equal to the peak-to peak voltage on the column conductor, which in turn is equal to the difference between the rms saturation and threshold voltages Vsat and Vth. As the voltage across the diode ring increases, larger leakage currents flow through the diodes and vertical crosstalk appears. For a given level of display performance it is possible to derive a maximum acceptable diode voltage which is shown at Vdm in FIG. 3. This means that the display will only operate correctly if the condition:

$$Vsat - Vth < Vdm \quad (3)$$

is satisfied. Vdm can be controlled by placing several diode rings in series or by varying the way in which the diodes are fabricated so that the slope of the diode I-V curve is changed. The latter approach only allows small changes to be produced so the main way in which the diode ring characteristics can be matched to the liquid crystal is to place a number of diode rings in series until Vdm for the combination satisfies the above equation. Two examples of the circuit of a typical picture element employing a number of diode rings in series as the non-linear resistance element is shown in FIGS. 6(*a*) and 6(*b*).

Clearly, the smaller the difference between Vsat and Vth, the fewer diode rings are needed. However, a certain minimum difference is needed to allow grey scale levels to be accurately reproduced. The use of a minimum number of diode rings is desirable for two reasons. Firstly, the chances of producing a faulty diode increase as the number of diodes increases and so the yield of good displays becomes lower as numbers increase. Secondly, for a display device operated in the transmission mode, and bearing in mind that the diodes are usually fabricated side by side and situated adjacent an electrode of their associated display element on a substrate of the device, the effective optical transmission area of the display becomes smaller as more diodes are used, making the display dimmer for a given backlight power.

It has been found that in operation the known display system can exhibit unwanted vertical cross-talk effects and that the minimum number of series connected diode rings necessary for acceptable performance in reducing the level of cross-talk exhibited is greater than the number expected as a result of the above theoretical considerations. Because of this, the display system is likely to suffer more than expected from the above described problems.

SUMMARY OF THE INVENTION

It is an object of the present invention to provide an improved matrix display system in which the aforementioned operational problems are obviated at least to some extent.

More particularly, it is an object of the present invention to provide a matrix display system operable such that, compared with the known system, the level of unwanted vertical cross-talk is reduced while at the same time the number of series diode rings needed for each picture element is kept to a minimum, so as to avoid the problems described with regard to large numbers of diodes.

According to the present invention, a matrix display system comprising: a plurality of row and column conductors; a plurality of liquid crystal picture display elements connected in series with an associated two terminal non-linear resistance element exhibiting a threshold characteristic between a row conductor and a column conductor; and drive signal generating means for applying drive signals to the row and column conductors for driving the display elements, the drive signal supplied to one of the two conductors associated with each picture element consisting of a selection signal portion during which the display element is set to a desired display condition, and a sustain signal portion for sustaining that display condition during a subsequent interval prior to the picture element receiving a further selection signal portion; is characterised in that the sustain signal portion voltage supplied by the drive signal generating means is decreased in magnitude over its duration.

Preferably, the sustain signal portion is decreased gradually, either continuously or in steps, such that the mean voltage obtained across the non-linear resistance element is substantially minimised for the duration of the sustain signal portion.

In a preferred embodiment, the magnitude of the sustain signal portion voltage is varied substantially in accordance with the decay time constant of the liquid crystal material of the display element.

The invention stems from a recognition that the cross talk problems associated with the known display system, and the consequent need for greater numbers of series connected diode rings than predicted theoretically, derives from a behavioural characteristic of the liquid crystal material employed.

In the above discussion of the operation of the known system, it was assumed that the voltage across the liquid crystal display element does not decay. In practice this is not the case. The charge on the display element slowly leaks away due to the inherent resistivity of the liquid crystal material and this has important implications for the operation of diode rings. As described above the constant sustain voltage, Vh, applied to the rows is set to minimise the voltage across the diode rings for any possible combination of column and display element voltages for a situation in which the display voltage does not decay. If the display element voltage decays during each TV field period then the range of voltage which can appear across the diode rings is increased by the amount of this decay. Thus the peak to peak voltage across the diode rings, Vdp, is much larger when the voltage across the liquid crystal display element decays. The condition for an acceptable level of crosstalk given in equation (3) then becomes:

$$Vsat - Vth + Vdecay < Vdm \quad (4)$$

where Vdecay is the amount by which the display element voltage decays during one TV field (20 mS). This means a larger value of Vdm is required which, in turn, explains why more diode rings are needed in series for each picture element.

The invention, however, which in another aspect relates also to a method of driving the kind of display system described in the aforementioned manner, involves an improvement to the row driving wherein the row drive signals are modified in such a way as to reduce the effect of the decay in the liquid crystal voltage on the display crosstalk performance without having to increase the number of diode rings used per picture element. More particularly this improved drive involves controlling the sustain voltage such that it is no longer constant but is made to decrease so as to compensate for the effects of decay of the voltage across the display element. A decrease in the sustain signal voltage will tend to reduce the deleterious effect of any decay in charge in the display element on the voltage obtained across the non-linear element.

A simple drop in the sustain signal voltage would be helpful to some extent. However, particularly beneficial results are achieved if the sustain signal voltage is decreased gradually over its duration substantially in dependence upon charge decay in the display element so that, taking into account the charge decay in the display element, the mean voltage across the non-linear element is substantially minimised with no potentially harmful increase likely to lead to vertical cross-talk problems being produced during the presence of the sustain signal. When the sustain signal portion voltage is varied with a time constant substantially equal to that of the liquid crystal material of the display elements, the decay in the liquid crystal display element no longer produces any noticeable increase in the voltage across the non-linear resistance element.

The invention is beneficial to display systems using diode rings as non-linear resistance elements, although it may be used to advantage with other types of diode structures such as, for example, MIMs or back-to-back diodes.

BRIEF DESCRIPTION OF THE DRAWINGS

A liquid crystal matrix display system and its method of operation in accordance with the present invention will now be described, by way of example, with reference to the accompanying drawings, in which:

FIG. 10 illustrates diagrammatically one form of drive circuit for use in driving row conductors in a display system according to the present invention, together with some of the associated voltage waveforms appearing therein.

DETAILED DESCRIPTION OF THE PREFERRED EMBODIMENTS

Figure 3:
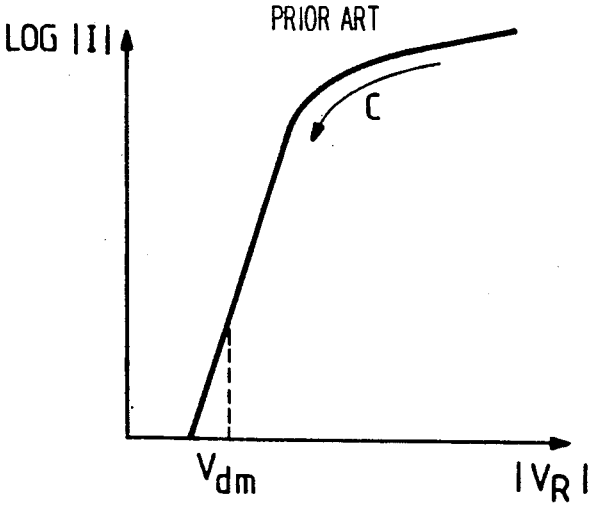
Fig. 3. PRIOR ART
FIG. 3 illustrates graphically the current-voltage curve of a known bidirectional non-linear resistance element exhibiting a threshold characteristic, for example a diode ring circuit.
Figure 5:
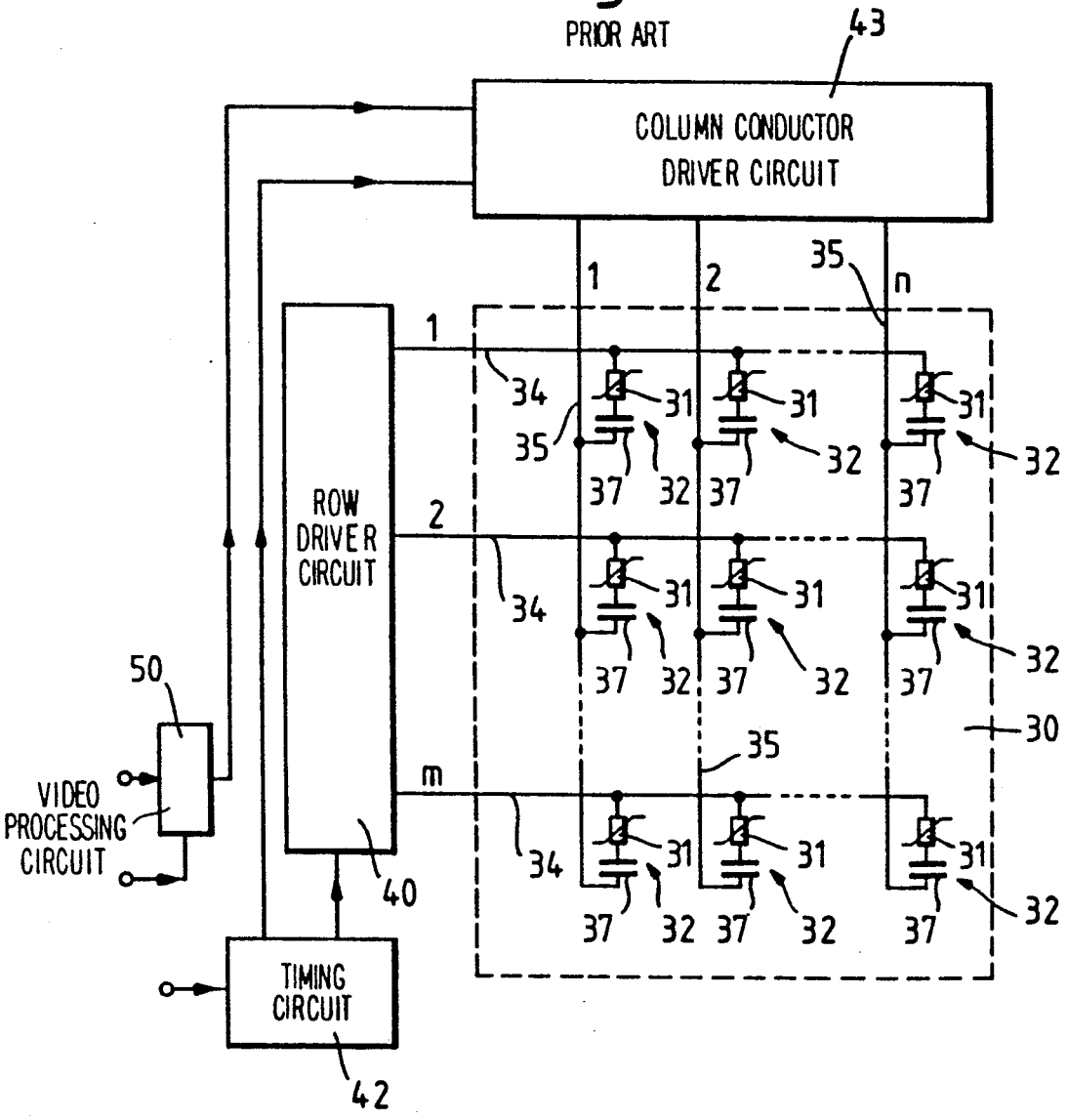
Fig. 5. PRIOR ART
FIG. 5 is a simplified block diagram of a known liquid crystal matrix display system intended for displaying TV pictures and including a display panel comprising an array of individually addressable picture elements each consisting of a display element in series with a non-linear element.
Figure 7A:
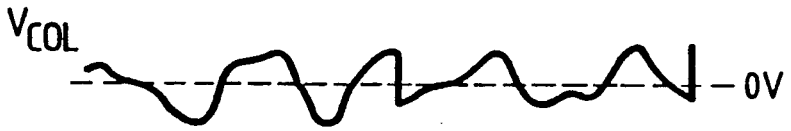
FIGS. 7*a–d* show typical voltage waveforms associated with a picture element of the system of FIG. 5 and comprising respectively the drive signal, Vcol, applied to a column conductor, the drive signal, Vrow applied to row conductor, the voltage $V_p$ appearing across the display element, and the peak-to-peak voltage Vdp appearing across the non-linear resistance element of the picture element.
Figure 7B:
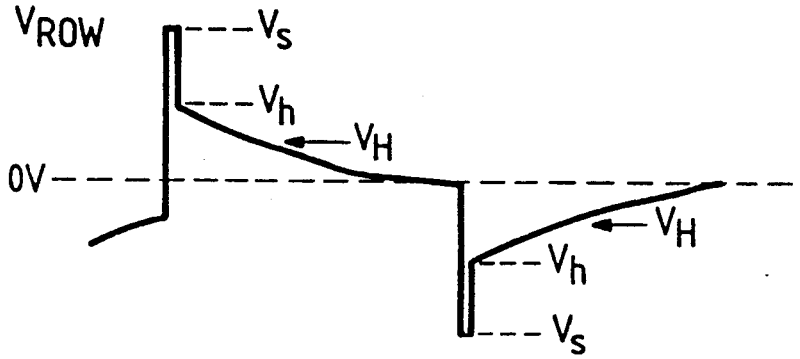
Figure 7C:
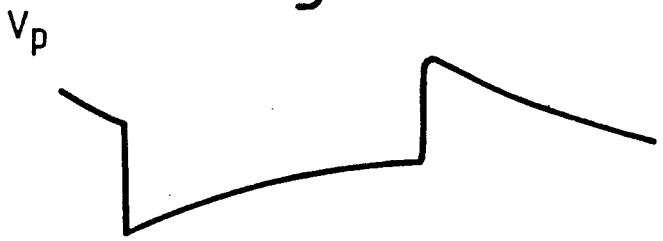
Figure 7D:
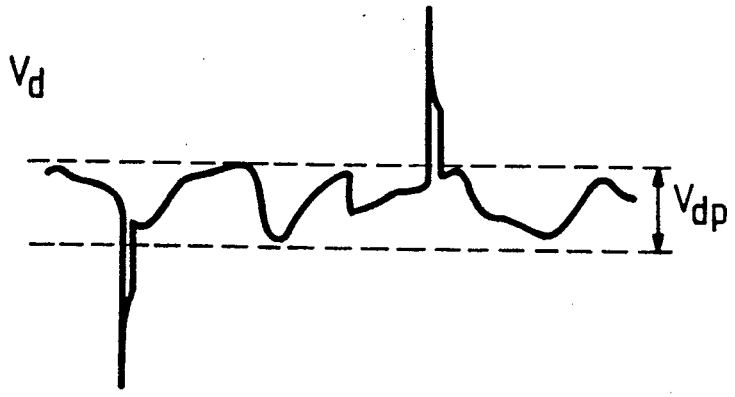
Figure 8A:
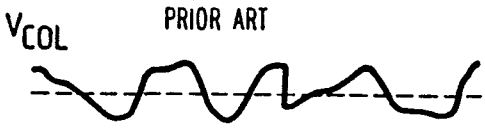
Fig.8(a) PRIOR ART
FIGS. 8*a–d* and 9*a–d* illustrate for comparison corresponding voltage waveforms in a similar matrix display system but in which the picture elements are driven in known fashion, the waveforms of FIG. 8 being applicable to an ideal case where the liquid crystal display element does not suffer leakage and FIG. 9 being applicable to a case where leakage exists.
Figure 9A:
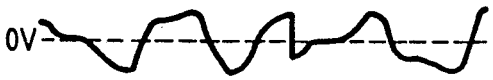
Fig.9(a) PRIOR ART
Figure 8B:
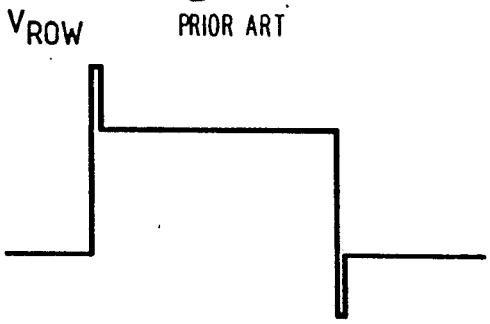
Fig.8(b) PRIOR ART
Figure 9B:
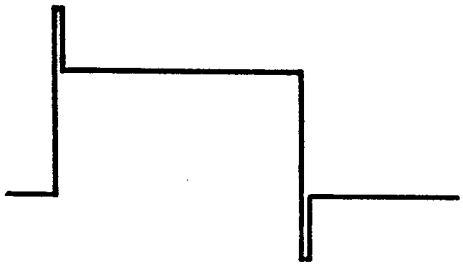
Fig.9(b) PRIOR ART
Figure 8C:
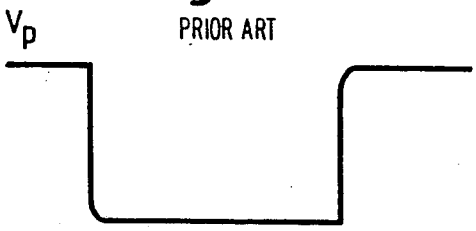
Fig.8(c) PRIOR ART
Figure 9C:
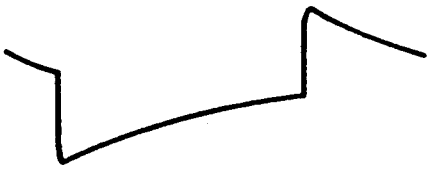
Fig.9(c) PRIOR ART
Figure 8D:
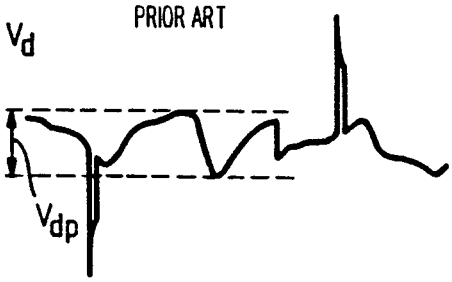
Fig.8(d) PRIOR ART
Figure 9D:
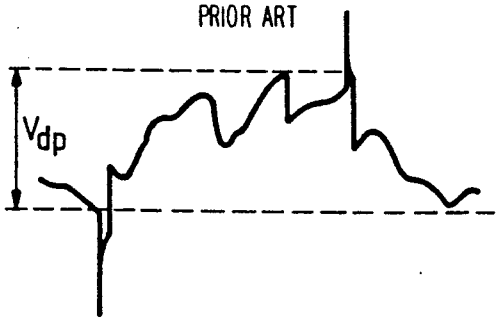
Fig.9(d) PRIOR ART

Referring to FIG. 5, there is shown schematically and in simplified form a block diagram of a known LCD-TV matrix display system which includes an active matrix addressed liquid crystal display panel 30 consisting of m rows (1 to m) with n horizontal picture elements 32 (1 to n) in each row. In practice, the total number of picture elements (m·n) in the matrix array of rows and columns may be 200,000 or more. Each picture element 32 consists of a liquid crystal display element 37 connected electrically in series with a bidirectional non-linear resistance element 31 exhibiting a threshold characteristic and acting as a switching element between a row conductor 34 and a column conductor 35. The current/voltage characteristic of the elements 31 is as shown in FIG. 3. The picture elements 32 are addressed via these sets of row and column conductors 34 and 35 which are in the form of electrically conductive lines carried on respective opposing faces of two, spaced, glass supporting plates (not shown) also carrying the electrodes of the liquid crystal display elements. The two sets of conductors extend at right angles to each other with the picture elements located at their cross-over regions.

Figure 2:
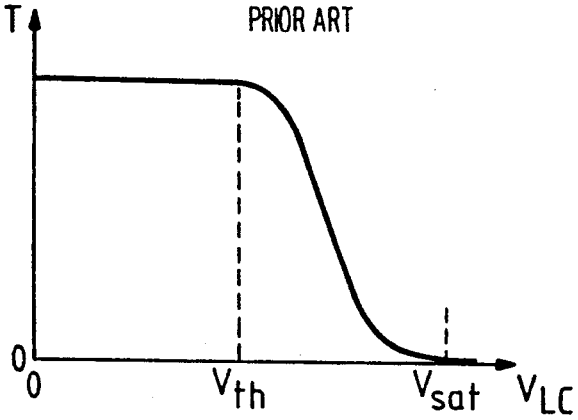
Fig. 2. PRIOR ART
FIG. 2 illustrates graphically the transmission-voltage characteristic of a known liquid crystal display element.

The row conductors 34 serve as scanning electrodes and are controlled by a row driver circuit 40 which applies a scanning signal to each row conductor 34 sequentially in turn. In synchronism with the scanning signals, achieved by means of the timing circuit 42, data signals are applied to the column conductors 35 from column conductor driver circuit 43 connected to the output of a video processing circuit 50 to produce the required display from the rows of picture elements associated with the row conductors 34 as they are scanned. In the case of a video or TV display system these data signals comprise video information. By appropriate selection of the scanning and data signal voltages, the optical transmissivity of the display elements 37 of a row are controlled to produce the required visible display effect. The display elements 37 have a transmission voltage characteristic as shown in FIG. 2 and are only activated to produce a display effect in response to the application of both the scanning and data signals to the picture elements 32 by means of the non-linear elements 31. The individual display effects of the picture elements 32, addressed one row at a time, combine to build up a complete picture in one field, the picture elements being refreshed in a subsequent field.

Using the transmission/voltage characteristics of a liquid crystal display element, as depicted in FIG. 2, grey scale levels can be achieved.

The voltage/conduction characteristic of the two-terminal non-linear elements 31 is bidirectional and substantially symmetrical with respect to zero voltage so that by reversing the polarity of the scanning and data signal voltages after, for example, every complete field a net dc bias across the display elements is avoided.

Active matrix liquid crystal display systems employing two terminal non-linear resistance elements as switching elements in series with the display elements are generally well known and hence the foregoing description of the main features and general operation of the display system with regard to FIG. 5 has deliberately been kept brief for simplicity. For further information, reference is invited to earlier publications describing such types of display systems, such as, for example, U.S. Pat. No. 4,223,308 and British Patent Specification No. 2,147,135, both describing the use of diode structures as non-linear switching elements, and British Patent Specification No. 2,091,468, describing the use of MIMs (Metal-Insulator-Metal devices) as non-linear switching elements, details of which are incorporated herein by reference.

Figure 1A:
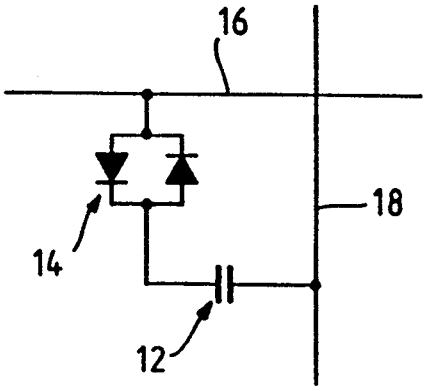
Fig. 1(a) PRIOR ART
FIGS. 1*a* and 1*b* illustrate alternative forms of circuits of a typical picture element connected between a row and column conductor in a known matrix display system using diode ring circuits as non-linear resistance elements.
Figure 1B:
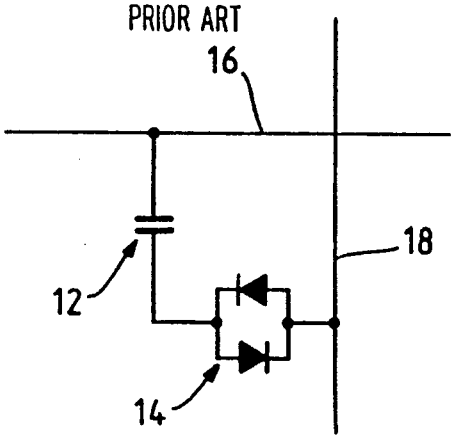
Fig. 1(b) PRIOR ART
Figure 6A:
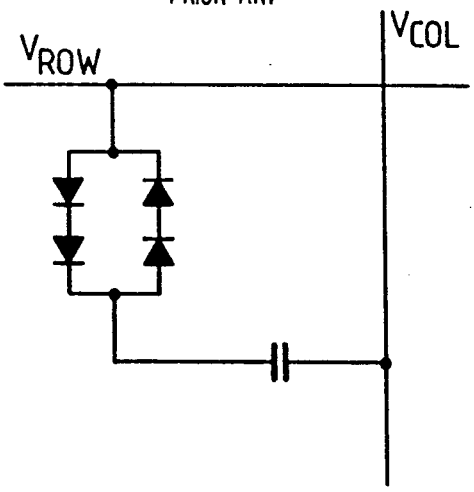
Fig.6(a) PRIOR ART
FIGS. 6(*a*) and 6(*b*) illustrate examples of known possible circuit configurations of a typical picture element of the display panel using diode rings for the non-linear elements.
Figure 6B:
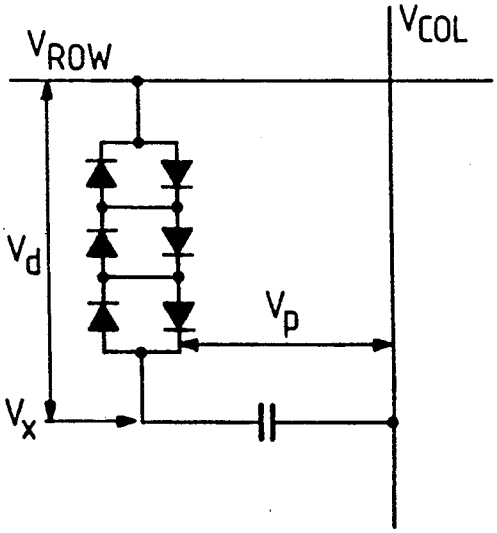
Fig.6(b) PRIOR ART

In the particular embodiment of the invention described here, the non-linear elements 31 comprise diode rings (as described for example in the aforementioned British Patent Specification No. 2,147,135), although it will be appreciated that other forms of bidirectional non-linear resistance elements exhibiting a threshold characteristic may be used instead. The circuit of each picture element 32 may be similar to that shown in FIGS. 1(*a*) or 1(*b*) of the accompanying drawings. Although the diode ring circuit in these Figures is shown simply as two diodes connected in parallel and with opposite polarity, variations are possible. For example, each of the parallel branches may comprise two or more diodes in series, as depicted in FIG. 6(*a*). Alternatively, the diode ring circuit may comprise two or more of the diode rings shown in FIGS. 1(*a*) or 1(*b*) connected in series, as depicted in FIG. 6(*b*). Other suitable forms of bidirectional non-linear switching elements such as MIMs may be used instead.

Figure 4A:
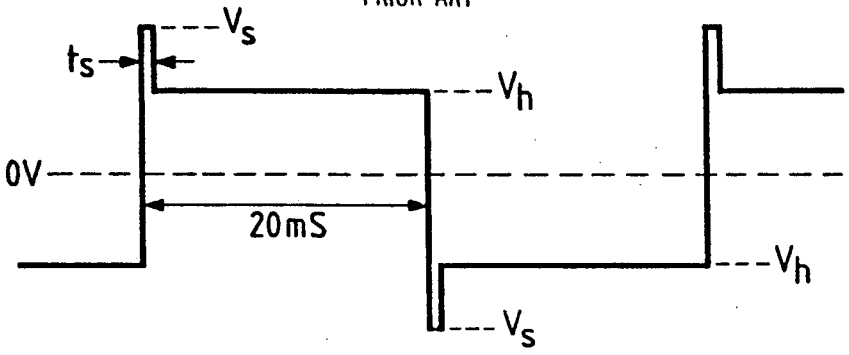
Fig.4(a) PRIOR ART
FIGS. 4*a* and 4*b* show an example of the waveforms applied to a row and a column conductor respectively for driving the picture element in a known driving scheme.

As previously described, row scanning in matrix display systems of the above kind is normally accomplished using a waveform comprising a row select signal portion of duration $t_s$ and magnitude Vs, followed immediately by a sustain, or hold, signal portion of lower, but similar polarity, voltage Vh for the remainder of the field period, as shown in FIG. 4*a*. In order to alleviate the problem of vertical cross-talk in such display systems caused by charge leakage in the liquid crystal display elements during the sustain period, resulting in diodes of other picture elements which should be in a high impedance state being turned on, it is possible for a number of diode rings to be connected in series in the manner shown in FIG. 6*b*. However, this has the disadvantage that the increased numbers of diodes then necessary can cause further problems with yield and optical transparency of the display panel.

With the present invention, however, the row conductors 34 of the display panel are driven with modified scanning signals such as to reduce greatly the likely effects of charge decay in the liquid crystal display element voltage on the panel's cross-talk performance, without increasing the number of diodes used for each picture element.

Figure 4B:
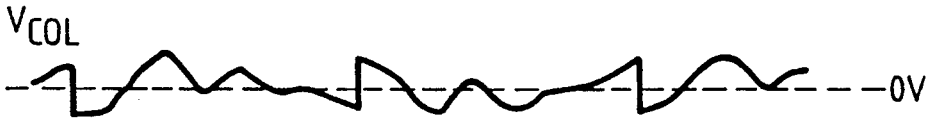
Fig.4(b) PRIOR ART

With regard to FIG. 7(*b*), there is shown a portion of the waveform of the scanning signal Vrow applied to a typical row conductor 34 of the panel. Comparing this waveform with that used previously as shown in FIG. 4(*a*), it can be seen that while the select signal portion Vs remains the same, the sustain signal portion, VH, gradually decreases from a maximum Vh during the remaining field period in accordance with decay characteristics of charge in the display element rather than staying substantially constant. FIG. 7(*a*) shows an example of a data signal waveform, Vcol, applied to a typical column conductor 35. FIGS. 7(*c*) and 7(*d*) show respectively the resulting voltage, Vp, appearing across the liquid crystal display element 37 as determined by equation (1), and the voltage drop, Vd, across the non-linear element 31, where, assuming Vx is the voltage at the junction between the non-linear element 31 and the display element 37, $$Vd = Vx - Vrow \text{ and } Vp = Vcol - Vx.$$

The effect of this difference in the scanning signal waveform can be seen by comparing FIGS. 7(*a*)–7(*d*) with the corresponding waveforms shown in FIGS. 8(*a*)–8(*d*) and 9(*a*)–9(*d*), both of which apply to a situation where the sustain signal portion voltage is maintained substantially constant. FIGS. 8(*a*)–8(*d*) relate to an ideal situation where it is assumed no charge decay in the liquid crystal display elements exists, whereas FIGS. 9(*a*)–9(*d*) relate to a real situation in which such leakage occurs. It can be seen from FIGS. 7(*d*) and 9(*d*) particularly that the peak to peak voltage Vdp existing across the non-linear element 31 is much smaller when the sustain signal portion is appropriately varied during the field period, because the decay of charge in the display element is compensated and no longer produces an increase in the voltage across the non-linear element. In comparison, the voltage Vdp existing when the sustain signal portion is held constant, FIG. 9(*d*), is much larger as a consequence of gradual charge leakage in the display element so that a larger value of Vdm (Equations (3) and (4)) is required.

For optimum results in which the voltage existing across the diode Vd (FIG. 7*d*) approaches closely that expected in the ideal situation assuming no display element charge leakage (FIG. 8*d*), the sustain signal portion voltage VH gradually decays from a maximum $V_h$ with a time constant substantially equal to that of the liquid crystal material of the display elements 37.

The row driver circuit 40 may be of any convenient form for generating the required scanning signals on the row conductors 34. One form of circuit suitable for this purpose will now be described with reference to FIG. 10(*a*) which illustrates a part of the circuit associated with the first two row conductors of the display panel 10, together with FIGS. 10(*b*)–(*d*), which show typical examples of waveforms involved.

The circuit 40 includes a shift register 60 which is supplied with a LOAD pulse LD and clocked at line synchronisation frequency of the signal to be displayed, i.e. every 64 microseconds for a TV display, by an input waveform CLK derived from the timer circuit 42 from a line synchronisation signal, LS. This clocking causes a single "high" pulse to propagate down the shift register outputs OP1, OP2, OP3, etc. On the first clock cycle OP1 goes high causing an associated analogue switch S1A to close. Upon closing, the switch S1A connects the input of a unity gain buffer A1 to a line at the required select voltage Vs thereby making the output voltage at output V1 connected to the first row conductor 34 also equal to Vs.

On the next positive edge of waveform CLK, output OP1 goes low and output OP2 goes high. This allows switch S1A to open and causes analogue switches S1B and S2A to close. As a result, the buffer A1 is connected to a line at voltage Vh and the output V1 is set to the initial sustain voltage Vh. At the same time, switch S2A operates to connect buffer A2 with the line at voltage Vs thereby causing row output V2, connected to the second row conductor 34, to go to the select voltage Vs.

On the next positive edge of the clock waveform CLK, shift register outputs OP2 and OP3 go low and high repectively. These cause the next row output, V3, not shown, to go to the select voltage level Vs via switch S3A, and row output V2 to go to the initial sustain level Vh. Also switch S1B is opened so that the input of buffer A1 is disconnected from any voltage supply line. From this point on until the switch S1A is next closed by shift register output OP1 going high one field period (20 ms) later, the voltage at row output V1 supplied to the first row conductor 34 is controlled by the voltage stored on capacitor C1. Since the unity gain buffers A1, A2, etc., are constructed to have a high input impedance, the voltage on C1 will decay exponentially with a time constant determined by capacitor C1 and the parallel resistor R1.

This exponential decay of the sustain signal voltage VH from its maximum Vh is substantially the waveform required, provided the time constant R1·C1 is made approximately equal to the time constant for charge decay of the liquid crystal display elements 37. Similarly, the sustain signal decay for other row conductors 34 is determined by the associated resistors and capacitors R2, C2, etc.

By making the resistors R1, R2, etc., controllable by an external control voltage, $V_{RC}$, the form of the sustain signal VH can be adjusted to match the requirements of the display elments.

The row driver circuit can be fabricated as an integrated circuit. As such, there are several ways in which these resistors can be made variable. For example, each resistor R1, R2, etc., may comprise a set of binary weighted resistors which can be switched in and out of circuit by a series of analogue switches controlled by digital signals. Alternatively, a series of MOS transistors may be used in a non-saturated state for each of the resistors R1, R2, etc., to provide voltage controlled resistors. Small variations in the effective value of the resistors R1, R2, etc., with the voltage across them are not critical, as a considerable reduction in the voltage across the non-linear elements 31 is still obtained even if the decay in the sustain signal Vh is not precisely exponential.

It will be appreciated that upon subsequent clocking of the shift register 60 by the signal CLK, the row outputs V2, V3 and so on to row output Vm for the mth row conductor 34 will in succession be driven in similar fashion to that described above with regard to row output V1 so as to apply scanning signals to the row conductors 1 to m in turn. Switch SmB associated with output OPm for the mth row conductor is operated by the output OP1, as indicated in FIG. 10(*a*). For simplicity, only the output waveforms for the first two row outputs V1 and V2 and the two sub-circuits for providing these waveforms are shown in FIGS. 10(*b*)–(*d*). The remaining m-2 sub-circuits are identical with those shown.

Following operation of the row output Vm, signifying the completion of one complete field, the circuit 40 operation is repeated for the next field.

For this next field, however, the polarity of the voltages Vh and Vs is changed in order to meet the polarity inversion requirement for driving the display elements 37. The circuit 40 operates repeatedly in this fashion for succeeding fields, with polarity inversion of voltages Vh with Vs after each field.

While the above described row drive circuit provides a sustain signal VH which gradually and continuously decreased in magnitude over its duration, it is envisaged that in an alternative row drive scheme the sustain signal could be decreased over its duration in discrete steps.

I claim:

1. A matrix display system comprising a plurality of row and column conductors, a plurality of picture elements each comprising a liquid crystal display element connected in series with an associated two terminal non-linear resistance element exhibiting a threshold characteristic between a row conductor and a column conductor, and drive signal generating means for applying drive signals to the row and column conductors for driving the display elements, the drive signal supplied to one of the two conductors associated with each picture element, the drive signal consisting of a selection signal portion during which the display element is set to a desired display condition and a sustain signal portion for sustaining that display condition during a subsequent interval prior to the picture element receiving a further selection signal portion, characterized in that the sustain signal portion voltage supplied by the drive signal generating means is decreased in magnitude over its duration.

2. A matrix display system according to claim 1, characterized in that the sustain signal portion is decreased gradually such that the mean voltage obtained across the non-linear resistance element is substantially minimized for the duration of the sustain signal portion.

3. A matrix display system according to claim 2, characterized in that the magnitude of the sustain signal portion voltage is decreased substantially in accordance with the decay time constant of the liquid crystal material of the display element.

4. A matrix display system according to claim 2 or claim 3, characterized in that the sustain signal portion is decreased in continuous fashion.

5. A matrix display system according to claim 2 or claim 3, characterized in that the sustain signal portion is decreased in steps.

6. A matrix display system according to claim 2 or claim 3, characterized in that the drive signal generating means includes for each conductor to which selection signals and sustaining signals are applied a switch circuit and an output stage comprising a voltage storage circuit and connected to the associated conductor, the switch circuit being operable to connect the output stage to a source at the selection signal voltage and a source at a first level of sustain signal voltage in succession, and the voltage storage circuit including circuit elements for temporarily storing the sustain signal voltage and effecting decay in the sustain signal voltage from that first level.

7. A matrix display system according to claim 6, characterized in that the switch circuits are operable by a shift register circuit whose outputs are connected to the switch circuits.

8. A matrix display system according to claim 6, characterized in that each voltage storage circuit comprises an RC circuit arrangement which determines the decay characteristic of the sustain signal voltage.

9. A matrix display system according to claim 8, characterized in that the resistance value of the resistive element of the RC circuit arrangement is adjustable.

10. A matrix display system according to claim 1 characterized in that the non-linear resistance elements comprise diode structures.

11. A matrix display system according to claim 10, characterized in that the non-linear resistance elements comprise diode rings.

12. A matrix display system according to claim 7 characterized in that each voltage storage circuit comprises an RC circuit arrangement which determines the decay characteristic of the sustain signal voltage.

13. A matrix display system according to claim 12, characterized in that the resistance value of the resistive element of the RC circuit arrangement is adjustable.

14. A matrix display system according to claim 2, characterized in that the non-linear resistance elements comprise diode structures.

15. A matrix display system according to claim 3, characterized in that the non-linear resistance elements comprise diode structures.

16. A matrix display system according to claim 4, characterized in that the non-linear resistance elements comprise diode structures.

17. A matrix display system according to claim 5, characterized in that the non-linear resistance elements comprise diode structures.

18. A matrix display system according to claim 6, characterized in that the non-linear resistance elements comprise diode structures.

19. A matrix display system according to claim 7, characterized in that the non-linear resistance elements comprise diode structures.

20. A matrix display system according to claim 8, characterized in that the non-linear resistance elements comprise diode structures.

21. A matrix display system according to claim 9, characterized in that the non-linear resistance elements comprise diode structures.

22. A matrix display system according to claim 12 characterized in that the non-linear resistance elements comprise diode structures.

23. A matrix display system according to claim 13, characterized in that the non-linear resistance elements comprise diode structures.

* * * * *